US006527201B2

(12) United States Patent
Lieber

(10) Patent No.: US 6,527,201 B2
(45) Date of Patent: Mar. 4, 2003

(54) INTEGRATED COLOR SELECTING AND BLENDING SYSTEM FOR AIRBRUSHES

(76) Inventor: Max A. Lieber, 8614 Veterans Memorial, Houston, TX (US) 77088

( * ) Notice: Subject to any disclaimer, the term of this patent is extended or adjusted under 35 U.S.C. 154(b) by 0 days.

(21) Appl. No.: 09/877,505

(22) Filed: Jun. 9, 2001

(65) Prior Publication Data

US 2002/0185551 A1 Dec. 12, 2002

(51) Int. Cl.[7] ..... A62C 13/62

(52) U.S. Cl. ..... 239/304; 239/346; 239/413; 239/DIG. 14

(58) Field of Search ..... 239/152, 153, 239/302–305, 307, 310, 335, 375, 413, 415, 346, 432, 529, 525, 526, DIG. 14

(56) References Cited

U.S. PATENT DOCUMENTS

| | | | | |
|---|---|---|---|---|
| 4,508,271 A | | 4/1985 | Gress | |
| 4,546,922 A | * | 10/1985 | Thometz | 239/304 |
| 5,086,978 A | * | 2/1992 | Fertig | 222/144 |

* cited by examiner

*Primary Examiner*—Lisa A. Douglas
(74) *Attorney, Agent, or Firm*—A. M. Fernandez

(57) ABSTRACT

A color selection mechanism for an integrated color selecting and blending system utilizes a disc having a flat surface with an axial projection therefrom for connection to an airbrush in order to supply selected color paint under regulated air pressure from a group of bottles storing different colors of paint. An opening in a convex surface of the disc opposite the flat surface thereof at a predetermined radial distance from the axis of the projection is connected by a slant bore to the axial projection for passing paint under pressure to an airbrush. A cylindrical block having a concave surface for a tight matching fit with the convex surface of the disc has bores parallel to its axis at the predetermined radial distance. By turning the cylindrical block on its axis, the parallel bores, to which the paint tubes are connected, can be individually selected to supply paint by aligning any one of those bores with the slant bore opening of the convex surface of the disc. A cavity in the convex surface around the opening of the slant bore allows alignment of the center of the slant bore between any adjacent pair of those parallel bores for blending paints from the pair of bores.

1 Claim, 2 Drawing Sheets

INTEGRATED COLOR SELECTING AND BLENDING SYSTEM FOR AIRBRUSHES

TECHNICAL FIELD

The present invention relates to the art of airbrushes, and in particular to an improvement in the means for selecting any one of a group of colors stored in an array of small bottles or for blending adjacent colors of a spectrum represented by the group of stored colors.

BACKGROUND ART

Prior art airbrushes in general, and in particular airbrush assemblies having the capability of switching from one color to another selected from a group of preselected colors as disclosed by Ronald A. Gress in U.S. Pat. No. 4,508,271 (which by this reference is hereby incorporated herein) are shaped to be held like a pencil with a nozzle at a tip end. A source of pressurized air is connected to the airbrush at a point well behind the nozzle and behind a short section that includes a venturi. As the velocity of the pressurized air increases in passing through a constrictive throat in the venturi, air pressure decreases. Each of the array of small bottles storing different colors of paint has a flexible tube, one end of which is inserted through its bottle cap into the paint. The other end of each tube is connected to a selection means for coupling a selected tube, or an adjacent pair of the tubes in the case of blending two colors, to the venturi where the pressure of air flowing at increased velocity is lower than the static pressure of air over the paint in the bottles. In that manner, paint from one tube or two adjacent tubes is drawn into the venturi by suction and there entrained in the flowing air to the nozzle of the airbrush.

The paint selection means comprises three basic parts: a first part having a plurality of bores connected to respective flexible tubes inserted into the array of small bottles; a second part having a single bore for coupling a selected bore of the first part to an airbrush connector; and a valve plate affixed to the second part for selecting the bore of the first part to the single bore of the second part by pivoting the first part a fraction of a full turn relative to the second part.

The plurality of passages through the first part are disposed at radial distances from a central bore through which a bolt passes to so secure the valve plate to the first part so as to allow the first part to be pivoted by the artist relative to the second part. The second part includes a single bore for the passage of selected paint to a coupling at the other end of the bore directly to the airbrush. The valve plate includes a bore that matches on one side the single bore of the second part, but has an oval opening on the other side facing the first part with a major axis long enough to reach two adjacent bores connected to paint supply tubes when the valve plate is pivoted to a position having the center of the oval opening at the center between two adjacent bores connected to paint tubes, whereby the oval opening overlaps the adjacent tubes in order to select for blending two adjacent colors. Otherwise the valve plate is pivoted to a position having the center of the oval opening at the center of the selected paint supply bore while the valve plate covers adjacent paint supply bores in order to airbrush with only one color.

A problem with the prior art has been that when the needle valve in the airbrush is opened by the artist to paint, significant hesitation is experienced before paint mixes with the air sprayed out of the nozzle because of delay in the venturi sucking up paint into the tube and out into the airstream. A further problem is leakage of paint between the valve plate and the first part due to the weight of the first part and the flexible tubes connected to it. If a nut on the bolt is not tight or it loosens, the valve plate may tilt relative to the first part and the precision fit between the valve plate and that first part will fail, thus leaking paint, particularly while the artist is reversing airbrushing direction. This results in an unacceptable risk of leakage after extended use of the airbrush until the nut is again tightened on the bolt.

An object of the present invention is to provide a pressurized system for supplying paint to the airbrush venturi without delay each time the needle valve is opened. A further object is to eliminate the leakage problem in the color selection means of an airbrush and to integrate the airbrush and color selection means with an array of paint supply bottles, each bottle with regulated air pressure over the paint in the bottles to maintain a positive pressure on paint in the tube to the venturi in the airbrush ready for painting immediately after the needle valve is opened.

SUMMARY OF THE INVENTION

These and other objects of the invention are achieved in an integrated color selecting system for airbrushes with an improved color selection means comprising a disc having a convex surface on one side and a substantially flat surface on the other side thereof, and with an integral projection from the flat surface and an axial bore through the disc and projection. The projection serves the function of providing a paint-channel connection to the airbrush. A slant bore from the convex surface of the disc intersects the axial bore through the disc. The opening of the slant bore on the convex surface of the disc is centered a radial distance from the axial bore and is enlarged by a cavity that extends the reach of the slant bore on both sides for blending paint from adjacent bores equally spaced part at the same radial distance through a cylindrical block having an axial bore for a bolt and having a concave surface that matches the convex surface of the disc. The axial bore through the disc is countersunk on the convex side thereof to a depth that just does reach the slant bore and threaded to receive a short bolt passing through the axial bore of the cylindrical block to tighten the convex surface of the disc against the concave surface of the cylindrical block without intersecting the slant bore. The end of the countersunk bore is cut to present a conical surface to the end of the bolt when it is threaded in so that upon tightening the bolt a maximum force of friction is produced between engaging threads, thereby locking the bolt in place so that it will not turn relative to the disc while the cylindrical block is free to turn on the bolt.

The disc fits into a sleeve of uniform internal diameter and length substantially equal to the length of the cylindrical block. The sleeve has at one end (out of which the connector projection extends) an integral ring with a knurled surface for manually gripping the sleeve in order to pivot the sleeve about the axis of the disc. The disc is inserted with its connector projection extending out of the knurled ring of the sleeve, while the cylindrical block essentially covered by the sleeve. The cylindrical block includes two spaced O-rings press fit into grooves in the sleeve behind the disc with its concave surface against the convex surface of the disc. The O-rings maintain the axial alignment of the cylindrical block and disc with the sleeve and allow the cylindrical block to be pivoted with the sleeve. It should be noted that the disc itself will not pivot with the sleeve because its connector projection is held firmly by the coupling of the paint selecting means to the airbrush. The cylindrical block, preferably made of Teflon, is bored through from a flat face at one end and through the concave face at the other end to provide a number of parallel channels close to the O-ring grooves and spaced equally apart and at the same radial distance from the axis of the cylindrical block as the radial distance of the opening of the slant bore. These parallel channels allow paint to pass from their respective bottles to the interface of the concave and convex surfaces of the cylindrical block and the disc. The position of the slant bore opening at the interface selects a single color in one channel or, through the enlarged cavity around tat slant bore opening, a pair of adjacent colors for blending.

The parallel bores of the cylindrical block are countersunk through the flat surface to receive flexible paint tubes from the array of paint bottles, thus placing the O-ring grooves closer to the flexible paint tubes, preferably also made of Teflon. The paint tubes in the countersunk bores are thus locked in place by the O-rings, once the cylindrical block is press fit in the sleeve, due to the compressed O-rings crimping the paint tubes through a thin wall of the cylindrical block between the O-ring grooves and the countersunk bores for the paint tube.

The pressurized air applied to the airbrush while in use is also applied through a pressure regulator to a manifold which distributes air under steady pressure into the paint supply bottles so that the stored paint is always at a static pressure for maintaining the flexible tubes loaded with paint to the color selection and blending means in order that, when a needle valve in the airbrush is opened, the paint will be at the airbrush ready for mixing without having to rely on a venturi in the airbrush to draw paint three the paint tubes. All of flexible paint tubes are bundled together by coiling the flexible pressurized air tube around them all the way from the pressure manifold to the airbrush. Each of the bottle caps are attached to the pressure manifold by a short, threaded bolt from the inside of the cap, and each flexible paint tube is passed from inside its paint bottle through the cap bolt into the pressure manifold. The hole in the caps is of a diameter relative to the diameter of the tubes to allow air to seep from the pressure manifold into the bottles, thus maintaining air pressure over paint in the bottles at the regulated pressure in the bottle.

At the end of the manifold opposite the pressure regulator, all flexible paint tubes are passed through pressure relief means comprising a plug inside valve inserted into the manifold. That pressure relief is set by a spring at a pressure limit above the normal range of up to 25 psi at which the pressure regulator set, which is still below the pressure that the paint bottles can withstand. The spring holds the plug valve against a valve seat and the tubes pass through the valve seat and the plug valve. Any excess pressure will force the plug valve to open against the spring.

DETAILED DESCRIPTION OF THE INVENTION

Figure 1:
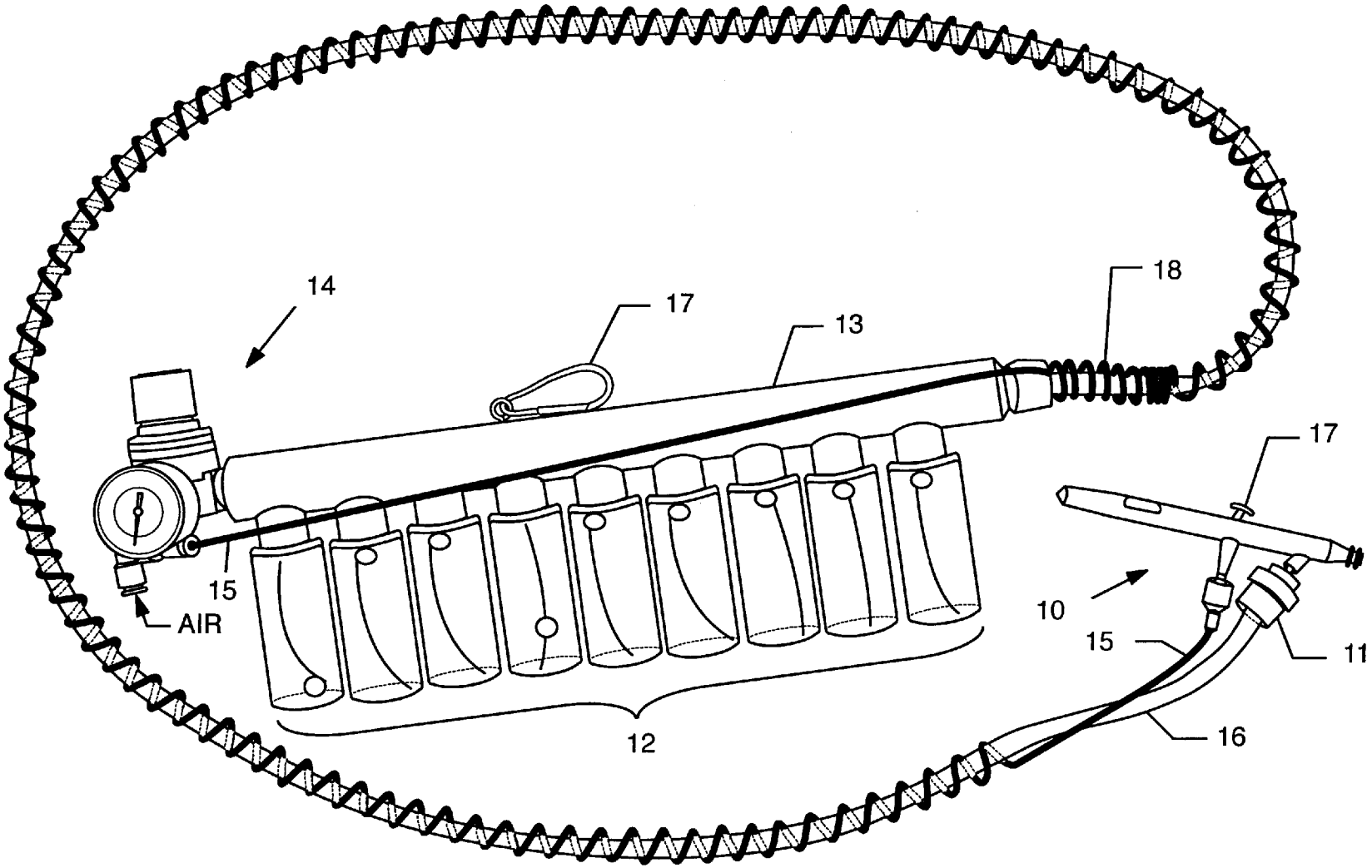
FIG. 1 illustrates an integrated airbrush system having means for selecting any one of a group of colored paint stored in a group of bottles pressurized with regulated pressure from a manifold.

Referring to FIG. 1, an integrated system is shown for an airbrush 10 and means 11 for selecting any one (or two for blending) of a group of colors stored in a set 12 of bottles attached to an air pressure manifold 13 so that paint in the bottles may be maintained at a regulated pressure that is set in a range of up to 25 psi at a regulator 14. Unregulated air pressure greater than 25 psi from a source (not shown) is connected by a T-junction to flexible tube 15 attached to the airbrush 10 and to the pressure regulator attached to one end of the air pressure manifold.

Each bottle of paint has a flexible Teflon tube immersed into the paint stored therein. The tube extends through its bottle cap into the manifold 13 and out the other end of the manifold (opposite the pressure regulator). All of the paint tubes inside the manifold pass through a valve at other end that fits tightly on a valve seat in the manifold, and through which the paint tubes are individually passed through equally spaced holes bored through the valve, such as in a circle centered on the axis of the valve.

The caps for the bottles 12 are secured to the manifold 13 by bolts from the inside of the cap so that the bottles may be quickly removed for cleaning and/or refilling. In order that pressurized air will not seep out of the manifold around the bolts, the threads and the head of the bolts are treated with a suitable sealing compound. Each bolt has a hole bored through its axis that is slightly larger than the tube diameter so that air under pressure may seep into the bottles to maintain the paint under positive regulated pressure. With the bottles upright, air under positive pressure will force paint through the tubes into the airbrush while in use. Meantime, air under pressure from the source is delivered to the airbrush through the flexible tube 15 that is wound around a bundle 16 of paint tubes that are connected to the means 11 for color selection and blending.

To maintain the bottles 12 upright, a snap-hook is fastened to the manifold 13 at a position near the center of the group of bottles, but on a side of the manifold opposite the bottles so they will always hang downwardly. The snap-hook should engage a support high enough from any obstruction that the group of bottles are all free to hang. The ends of the tubes inside the bottles will always be immersed in paint unless the artist inadvertently allows the bottle to run dry. The airbrush 10 is equipped with a spring-loaded control lever 17 which will automatically close an airbrush needle valve in order to stop the paint flow when released, and if stopped for an extended period, the source of pressurized air into the pressure regulator should be turned off. Otherwise, for a short period of interruption, once the lever 17 is released, the selection means 11 should be set to a position of no color selection to interrupt the flow of paint under positive pressure into the airbrush.

The pressurized air tube 15 connected to the airbrush from a tee at the air input connection to the pressure regulator 14 and is wrapped around the paint tubes 16 bundled from the end of the pressure manifold 13 to the airbrush 10 in order to keep them bundled for protection. A heavy resilient plastic kink protector coil 18 is also provided at the end of the pressure manifold to protect the paint tubes from kinking there should the artist move the airbrush too great a distance from the manifold. The kink protector is anchored around an end cap having an opening through which the bundle of paint tubes pass out the end of the manifold.

Figure 3:
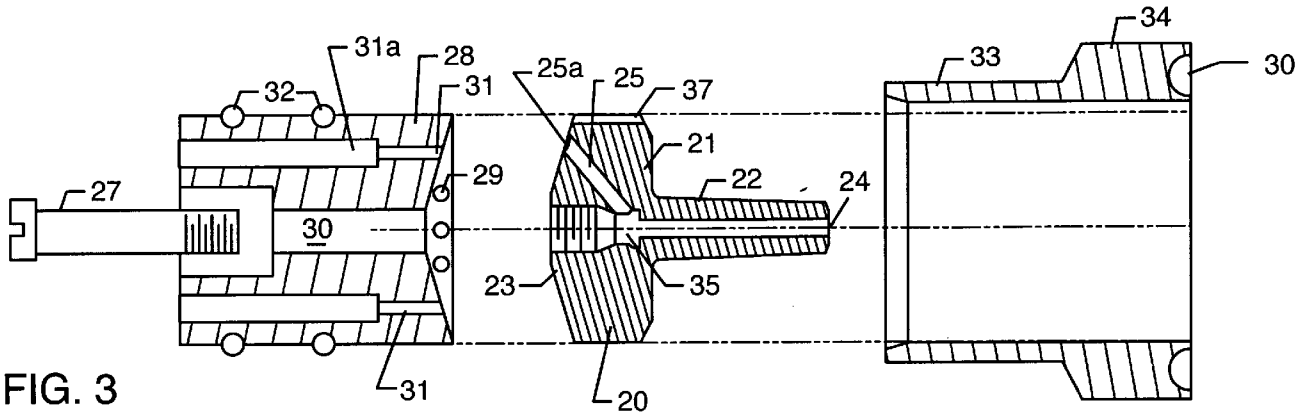
FIG. 3 illustrates in cross section an exploded view the parts of the selection means comprising a Teflon cylindrical block rotatable on its axes with a concave surface that fits with precision a convex surface of a disk that is held stationary by its connection to an airbrush while the cylindrical block is turned through turning the sleeve into which the cylindrical block is press fit.
Figure 2:
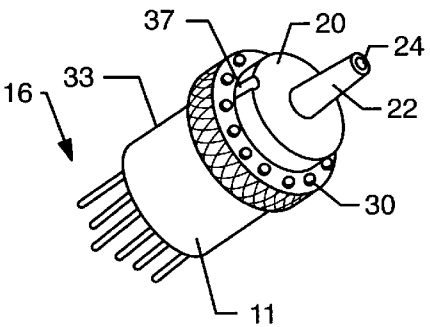
FIG. 2 is an isometric view of the selection means.
Figure 6:
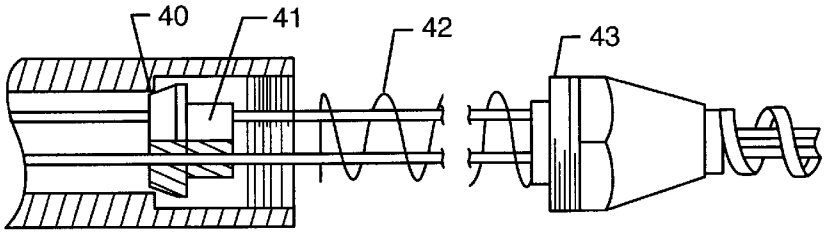
FIG. 6 illustrates a spring-loaded pressure relief valve for the pressure manifold at the end opposite a pressure regulator.

FIG. 2 is an isometric view of the selection means 11 assembled for use as shown in FIG. 1, and FIG. 3 is an exploded view of its parts shown in cross section, which will now be described comprising: a disc 20 having a substantially flat surface 21 with an integral projection 22, a convex surface 23 on the opposite side of the disc from the projection 22, an axial bore 24 through the disc and integral projection that is countersunk from the convex surface to intersect a slant bore 25 from the convex surface to the axial bore, and threaded with a tap having a cone cutting tip thread tapping up to the edge of the slant bore to receive the tip of a bolt 27; a cylindrical block 28 (preferably of Teflon) having a concave surface 29 at one end that precision fits into the convex surface 23 of the disk 20, an axial bore 30 for the bolt 27 countersunk to receive a slotted head of the bolt; a plurality of bores 31 parallel to the axial bore, one for each tube in the bundle 16 connecting the array of paint bottles to the selection means 11, slots for two O-rings 32; and a sleeve 33 having a raised portion 34 at one end with a knurled surface to serve as a ring for turning the cylindrical block about its axis, i.e., about the bolt 27.

When the bolt is inserted through the axial bore 30 of the cylindrical block and into the disc 20, its tip engages the conical surface 35 at the end of the thread. That conical surface produced by the cone cutting tip of the tap will then lock the bolt in place upon being tightened so that it will not turn in either direction when the sleeve 33 turns the cylindrical block 28. The O-rings compress when the cylindrical block is press fit into the sleeve 33 so that, when the sleeve is turned, the cylindrical block will turn, but the bolt does not turn because it is fixed in place in the disc 20, and that disc is in turn fixed in its place in the airbrush by a force of friction which is increased as the sloped wall of the slightly conical projection 22 is press fit into a connector having a correspondingly shaped fitting. In turning the bolt tight, the convex surface 23 of the disc is drawn tight against the concave surface of the cylindrical block 28, but because the block is made of slippery material, such as Teflon, the block will turn without turning the opposing disc 20.

Figure 5:
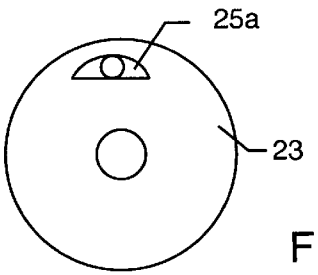
FIG. 5 is a plan view of the convex surface of the stationary disc.
Figure 4:
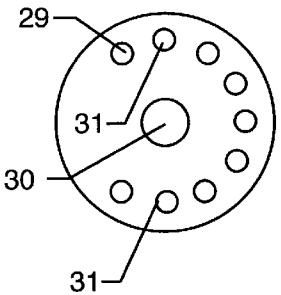
FIG. 4 is a plan view of the concave surface of the cylindrical block having equally spaced bores parallel to the block axis.

The bores 31 parallel to the axis of the cylindrical block are at the same radial distance from the bolt axis as the opening of the slant bore from the axis of the disc, as shown in FIGS. 4 and 5, so that when the knurled ring of the sleeve is turned, the cylindrical block is turned to select a bore through the cylindrical block by aligning the selected bore of the cylindrical block with the opening of the slant bore in the disc. In that manner the paint color of the bottle having its tube inserted into the aligned bore of the cylindrical block is selected. A cavity 25*a* at the opening of the slant bore extends beyond that opening as shown in FIG. 5 so that if the slant bore opening is centered between the opening of two adjacent parallel bores in the cylindrical block, that cavity will partially overlap the opening of each of the two parallel bores to blend the colors of paints on the two parallel bores.

Each of the parallel bores 31 in the cylindrical block is of a diameter less than the outside diameter of the paint tubes from the bottles. Consequently, to insert the paint tubes in the bores, the parallel bores are countersunk to enlarge the bore diameter from the flat surface of the cylindrical block to a position beyond O-rings 32 in order to receive the tubes with such a close fit as to require about 3 lbs of force to press fit the tubes into the countersunk portions 31*a* of the parallel bores. Once the paint tubes are inserted into their respective countersunk portions of the parallel bores 31 in the cylindrical block 28 and the cylindrical block is fitted with the O-rings 32, the cylindrical block is press fit into sleeve the 33. The pressure exerted on the compressed rings in turn compress the wall of the countersunk bore portions 31*a* of the bores 31 to slightly crimp the paint tubes so that about 15 lbs of force is necessary to pull the tubes out of the bores. The tube of each color is inserted in bores adjacent to its corresponding color dot 36 shown in FIG. 2 on the front annular face of the sleeve. The colors on the dots are permanently assigned initially or assigned by the artist after selecting the group of colors to be used, and the artist puts the color dots on the sleeve. In either case, the color of paint desired is selected by aligning a slot 37 on the side of the disc (or other indicia provided on the disc to mark the position of the slant bore opening) with a color dot on the sleeve 30 of the color desired for the paint to be used from the array of storage bottles.

As noted hereinbefore, all of the paint bottles 12 are pressurized by regulated pressure in the manifold 13. As a safeguard against excessive pressure in the manifold, a pressure relief valve is provided at the end of the manifold opposite the pressure regulator 14, i.e., at the end where the bundle of paint tubes exit the manifold. The manner in which that is accomplished, using a plug as the valve 40 in the form shown in FIG. 4 will now be described.

By increasing the internal diameter at the end of the manifold, which is cylindrical throughout the inside and cylindrical outside, except where the array of bottles are fastened, a valve seat 40 is formed that may be sloped, rounded, or for simplicity, a comer or step as shown. With a plug serving as the valve 41 closed by a spring 42 between the plug and an end cap 43 for the manifold, the comer of the valve seat seals against the plug made of resilient material, preferably Teflon, so that parallel bores may be made through the plug that seals around the flexible tubes passing from the paint bottles through the manifold and out through the pressure relief valve. That is accomplished by making the bores of a slightly smaller diameter than the outside diameter of the tubes for a tight fit of the tubes through the plug. Using Teflon for the plug valve 41 facilitates inserting the tubes through the bores.

If for any reason the manifold should exceed a predetermined pressure, such as 25 psi, a failure of the paint selection system might occur. To avoid such a failure, the spring 42 is selected to yield to the force of the excess pressure on the valve 41, allowing the valve to unseat. This then vents air as needed to keep the air pressure below the critical level. The vented air is allowed to escape through the kink protected coil 18 anchored to a cap 43 at the end of the manifold that has a large opening to allow the bundle of tubes 16 to pass out of the manifold. In hat manner, vented air is allowed to pass out into the atmosphere.

Although particular embodiments of the invention have been described and illustrated herein, it is recognized that modifications may readily occur to those skilled in the art. Consequently, it is intended that the claims be interpreted to cover such modifications and equivalents thereof.

What is claimed is:

1. In an integrated color selection system for an airbrush, a color selecting means comprising a disc having a flat surface on one side with an axial projection from said flat surface, and having a convex surface on a side opposite said flat surface with an axial bore through said convex surface and said projection for connection to an airbrush for supplying thereto paint of a color selected from a group of paints stored in an array of bottles fastened to an air pressure manifold, each bottle fastened by a bolt having an axial bore through which a paint tube having one end immersed in paint stored in said bottle and the other end extending through said bore in said bolt into said air pressure manifold and then out one end of said manifold, a slant bore from said convex surface of said disc intersecting said axial bore and a cavity on said convex surface around an opening to said slant bore having a dimension greater in one direction, said bore and cavity being centered at a predetermined radial distance from said disc axis, a cylindrical block having a concave face at one end with a precision fit over said convex surface of said disc, an axial bore passing through said cylindrical block and a plurality of bores parallel to said axial bore centered at said predetermined radial distance from said cylindrical block axis, and equally spaced apart such that said cavity over slant bore openings will not overlap an adjacent bore opening in said one direction on said concave surface when said slant bore opening is centered on any one bore opening of said cylindrical block and said cavity will overlap a such an adjacent bore when said slant bore opening is centered between such adjacent bores equally spaced from said axial bore said predetermined radial distance, whereby when said cylindrical block is rotated on its axis with its concave face against said convex surface of said disc, each successive opening of said parallel bores may be selected to be aligned with said slant bore opening, and each of said parallel bores is countersunk a predetermined partial distance to accept one of said paint tubes or an adjacent pair of paint tubes to extend from a respective one or pair of said paint bottles through said manifold.

* * * * *